US007108542B2

(12) United States Patent
Ishiwa

(10) Patent No.: US 7,108,542 B2
(45) Date of Patent: Sep. 19, 2006

(54) CONNECTOR APPARATUS WITH A MATING DETECTING MEMBER CALLED CONNECTOR POSITION ASSURANCE

(75) Inventor: Tadashi Ishiwa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/071,759

(22) Filed: Mar. 3, 2005

(65) Prior Publication Data

US 2005/0196943 A1 Sep. 8, 2005

(51) Int. Cl.
*H01R 3/00* (2006.01)

(52) U.S. Cl. ..... 439/489; 439/352; 439/752

(58) Field of Classification Search ..... 439/352, 439/489, 488, 350, 351, 353–358
See application file for complete search history.

(56) References Cited

U.S. PATENT DOCUMENTS

| | | | | |
|---|---|---|---|---|
| 4,634,204 | A | 1/1987 | Detter et al. | |
| 4,963,103 | A * | 10/1990 | Fink et al. | 439/352 |
| 5,120,240 | A * | 6/1992 | Reider | 439/352 |
| 5,330,360 | A * | 7/1994 | Marsh et al. | 439/76.1 |
| 5,759,058 | A * | 6/1998 | Childs et al. | 439/352 |
| 6,234,826 | B1 * | 5/2001 | Wilber et al. | 439/352 |
| 6,290,539 | B1 * | 9/2001 | Wilber et al. | 439/595 |
| 6,514,098 | B1 * | 2/2003 | Marpoe et al. | 439/352 |
| 6,716,052 | B1 * | 4/2004 | Kane | 439/352 |

FOREIGN PATENT DOCUMENTS

| | | |
|---|---|---|
| EP | 0732775 | 9/1996 |
| EP | 1209770 | 5/2002 |
| JP | H7-19631 | 3/1995 |

OTHER PUBLICATIONS

European Search Report.

* cited by examiner

*Primary Examiner*—Alexander Gilman
(74) *Attorney, Agent, or Firm*—Collard & Roe, P.C.

(57) ABSTRACT

A connector apparatus has a first connector, a second connector to be mated with and unmated from the first connector, and a mating detecting member for detecting a mated state and an unmated state of the first and the second connectors. The first connector has a lock lever to be engaged with the second connector. The mating detecting member has a detecting portion for detecting the mated and the unmated states, a holding portion for locking the mating detecting member at a standby position, and an operating portion for locking the mating detecting member at an assurance position. The detecting portion has a locking portion to be engaged with the lock lever. The holding portion is displaced in a direction different from the mating and the unmating directions to be engaged with the first connector.

9 Claims, 10 Drawing Sheets

CONNECTOR APPARATUS WITH A MATING DETECTING MEMBER CALLED CONNECTOR POSITION ASSURANCE

This application claims priority to prior Japanese patent application JP 2004-59648, the disclosure of which is incorporated herein by reference.

BACKGROUND OF THE INVENTION

This invention relates to a connector apparatus having a mating detecting member for detecting a mated state and an unmated state of a connector and a mating connector.

Japanese Patent Publication (JP-B) No. H7-19631 corresponding to U.S. Pat. No. 4,634,204 discloses an electrical connector apparatus comprising a male connector, a female connector to be mated with the male connector, and a mating detecting member for detecting a mated state of the male connector and the female connector.

The mating detecting member is slidable in a mating direction and an unmating direction opposite to the mating direction. When the male and the female connectors are mated to each other, the mating detecting member is inserted into the male connector to detect complete mating of the male and the female connectors. Thus, the mating detecting member is a component for assuring (confirming) that these connectors are completely mated at a proper position. The mating detecting member is called connector position assurance (CPA).

Further, the mating detecting member allows an operator to find an unmated state where the male and the female connectors are not properly mated.

However, the above-mentioned mating detecting member is disadvantageous in the following respects. Even if the male and the female connectors are in an unmated state, the mating detecting member can slide in the mating direction to be inserted into the male connector if an excessive force is applied by the operator. In this event, it is impossible to detect and confirm the mated state or the unmated state of the male and the female connectors.

When the male connector is released and removed from the female connector, the mating detecting member is not held by the male connector. Therefore, the mating detecting member may possibly be lost.

In the state where the electrical connector is mounted to an electronic apparatus, the mating detecting member may be released and separated from the male connector under an external force exerted by unexpected vibration, mechanical shock, or the like.

As described above, the mating detecting member is inserted into the male connector after the male and the female connectors are mated to each other. It is desired but is not realized that the mating detecting member can be inserted into the male connector with a small force so as to easily perform a normal operation.

SUMMARY OF THE INVENTION

It is therefore an object of this invention to provide a connector apparatus with a mating detecting member, which is capable of reliably achieving all of functions of detecting a mated state and an unmated state of a first connector and a second connector by the mating detecting member, preventing the mating detecting member at a mating assurance position from being easily displaced therefrom, and preventing the mating detecting member at a standby position from being easily released from the first connector.

It is another object of this invention to provide a connector apparatus with a mating detecting member, which is capable of preventing the mating detecting member from being released due to an external force exerted by vibration, mechanical shock, or the like.

It is still another object of this invention to provide a connector apparatus with a mating detecting member, which is capable of inserting the mating detecting member with a small force so as to easily perform a normal operation.

According to this invention, there is provided a connector apparatus comprising a first connector, a second connector to be mated with and unmated from the first connector in a mating direction and an unmating direction opposite to the mating direction, and a mating detecting member coupled to the first connector and slidable along the first connector in the mating and the unmating directions. In the connector apparatus, the first connector has a lock lever to be engaged with the second connector. The mating detecting member includes a detecting portion for detecting the mated state and the unmated state of the first and the second connectors, a holding portion for locking the first connector at a standby position where the first and the second connectors are in the unmated state, and an operating portion for locking the first connector at an assurance position where the first and the second connectors are in the mated state, the detecting portion having a locking portion to be engaged with the lock lever at the assurance position so that the mating detecting member is engaged with the first connector and prevented from being returned to the standby position, the holding portion being displaced in a direction different from the mating and the unmating directions to be engaged with the first connector, the operating portion making the mating detecting member be slidable from the standby position when the first connector is mated to the second connector.

DESCRIPTION OF THE DETAILED EMBODIMENTS

Figure 1:
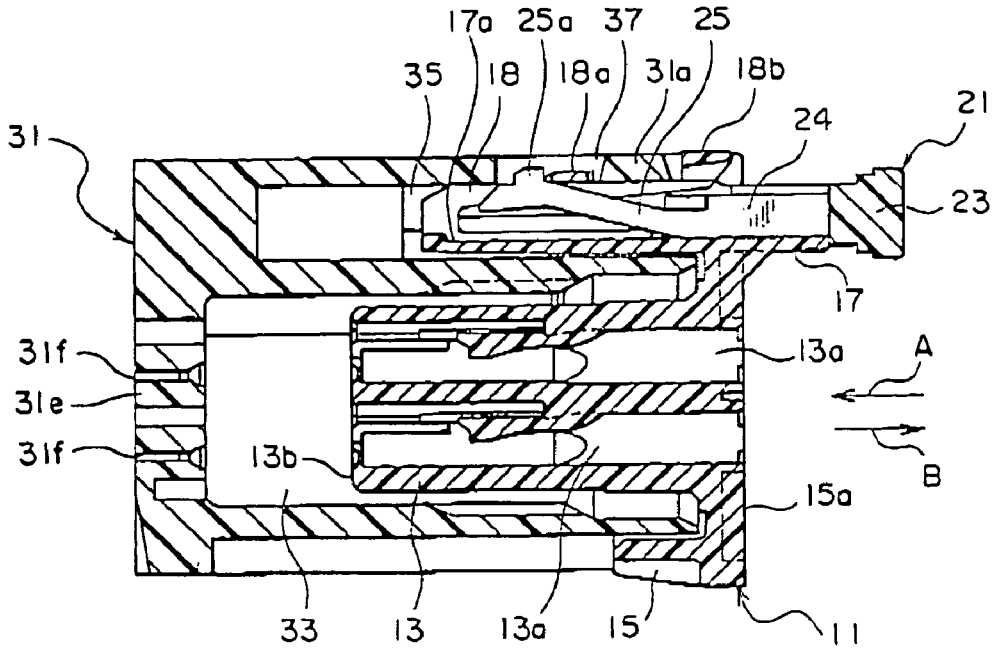
FIG. 1 is a vertical sectional view of a connector apparatus according to a first embodiment of this invention in a mated state with a mating detecting member located at a mating assurance position.

Now, description will be made of a few preferred embodiments of this invention with reference to the drawing.

Figure 2:
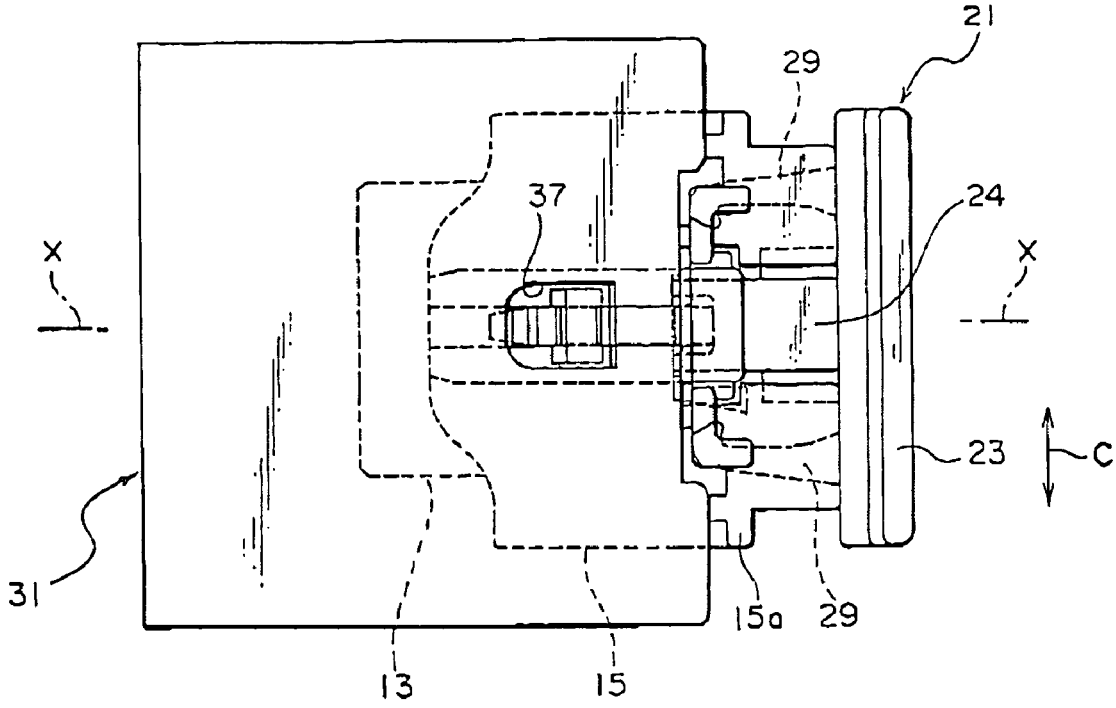
FIG. 2 is a plan view of the connector apparatus illustrated in FIG. 1.

Referring to FIGS. 1 and 2, a connector apparatus according to a first embodiment of this invention comprises a first connector (male connector) 11, a mating detecting member 21, and a second connector (female connector) 31. Each of the first connector 11, the mating detecting member 21, and the second connector 31 is formed by molding a resin material. In FIGS. 1 and 2, the first and the second connectors 11 and 31 are completely mated.

Figure 3:
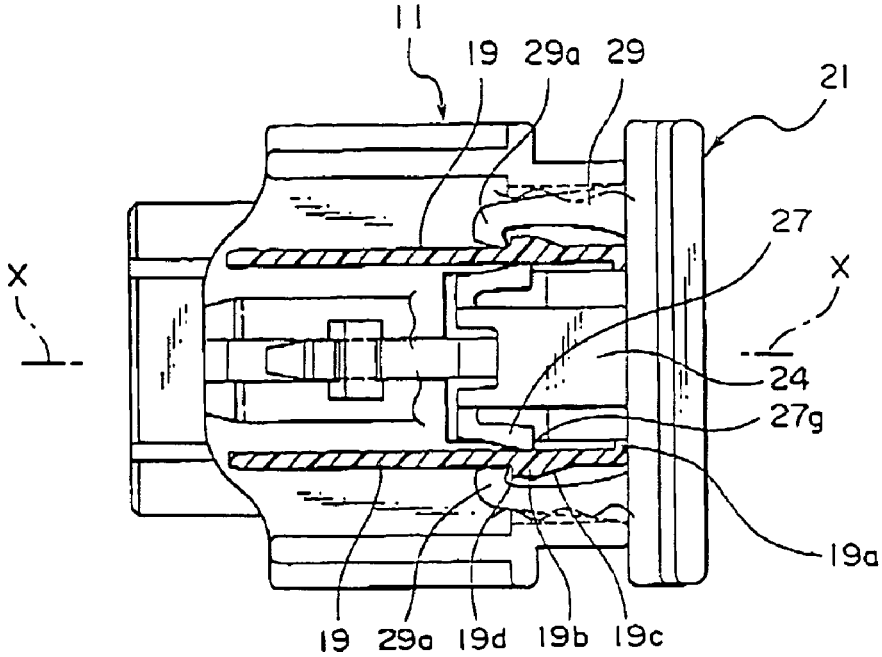
FIG. 3 is a plan view, partially in section, of a connector and the mating detecting member of the connector apparatus illustrated in FIG. 1.
Figure 4:
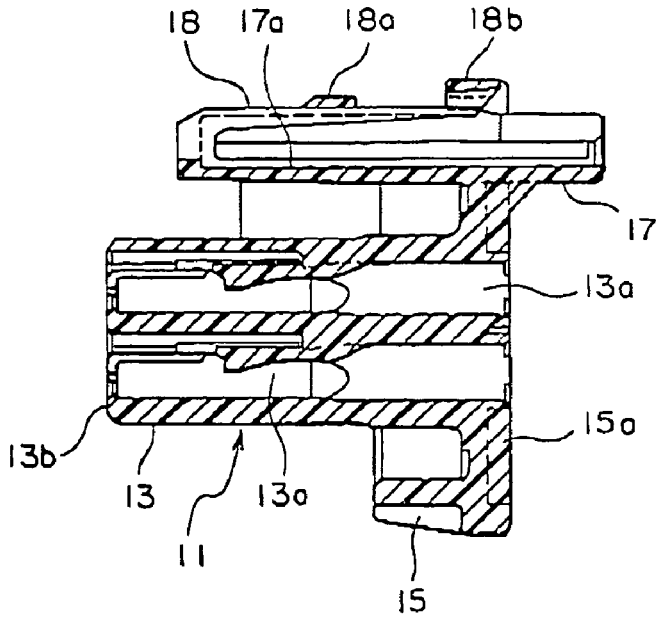
FIG. 4 is a vertical sectional view of the connector illustrated in FIG. 1.
Figure 5:
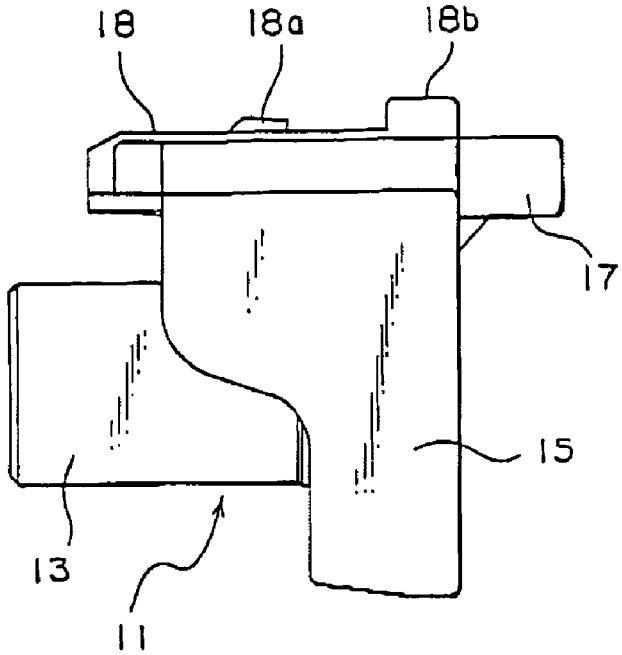
FIG. 5 is a side view of the connector illustrated in FIG. 4.
Figure 6:
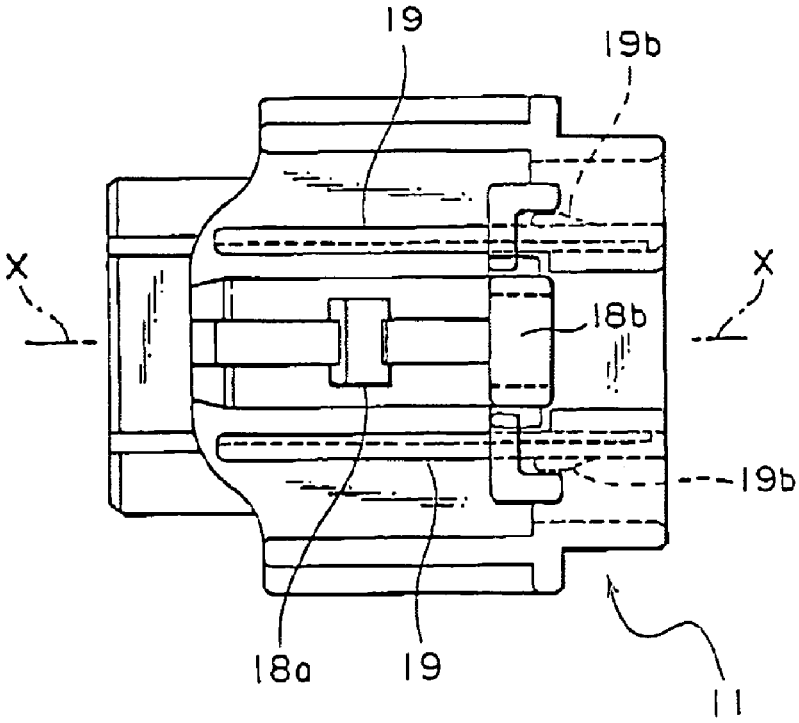
FIG. 6 is a plan view of the connector illustrated in FIG. 4.

Referring to FIG. 3, the mating detecting member 21 is inserted into the first connector 11. In FIGS. 4 through 6, the mating detecting member 21 is removed from the first connector 11.

As illustrated in FIGS. 3 through 6 also, the first connector 11 has a first mating portion 13 of a generally cylindrical shape, an outer frame portion 15 integrally formed with the first mating portion 13, and a detecting locking portion 17 disposed above the first mating portion 13 and connected to the outer frame portion 15.

The first mating portion 13 is inserted into the second connector 31 in a mating direction depicted by an arrow A in FIG. 1 to be mated with the second connector 31. The first mating portion 13 is provided with a plurality of contact receiving holes 13*a* for receiving a plurality of conductive contacts (not shown), respectively. Each of the contact receiving holes 13*a* extends long in the mating direction and an unmating direction depicted by an arrow B in FIG. 1 and opposite to the mating direction A.

The outer frame portion 15 surrounds the first mating portion 13 except a front part in the mating direction A, in other words, surrounds a part of the first mating portion 13 forward in the unmating direction B. The outer frame portion 15 is provided with a flange portion 15*a* formed at its end in the unmating direction B. The flange portion 15*a* is perpendicular to the mating and the unmating directions A and B.

The detecting locking portion 17 has a base portion 17*a* disposed above the first mating portion 13 and extending in the mating and the unmating directions A and B, and a lock lever 18 extending to face the base portion 17*a*.

The base portion 17*a* is located at a predetermined space from an upper outer surface of the first mating portion 13. In the mating direction A, the base portion 17*a* is located behind a mating end face 13*b* of the first mating portion 13. In the unmating direction B, the base portion 17*a* protrudes outward from an end face of the flange portion 15*a*.

The lock lever 18 is a portion to be engaged with the second connector 31 and to lock the second connector 31. The lock lever 18 is connected to one end of the base portion 17*a* in the mating direction A and extends to face the base portion 17*a*. The lock lever 18 is provided with a lever locking portion 18*a* formed at an intermediate position of the lock lever 18 in the mating and the unmating directions A and B. The lock lever 18 is provided with a lever operating portion (locking portion) 18*b* formed at its end in the unmating direction B and adapted to be pressed towards the base portion 17*a*.

Figure 7:
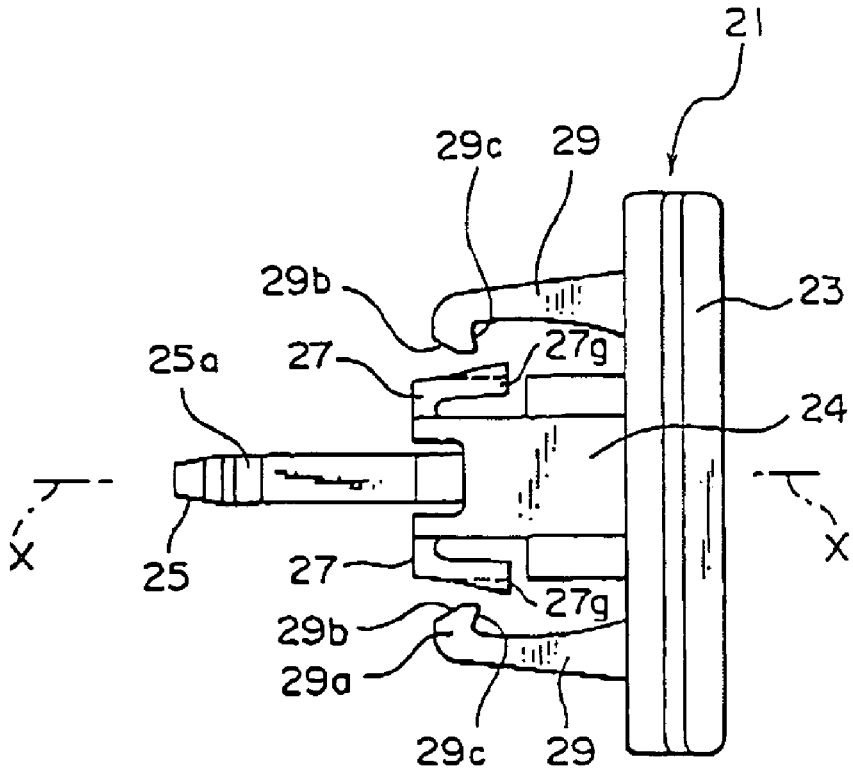
FIG. 7 is a plan view of the mating detecting member illustrated in FIG. 1.
Figure 8:
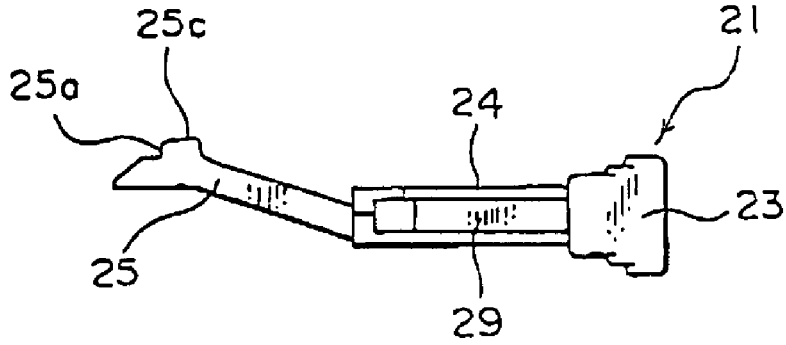
FIG. 8 is a side view of the mating detecting member illustrated in FIG. 7.

The mating detecting member 21 is slidably held by the first connector 11. As shown in FIGS. 7 and 8 also, the mating detecting member 21 has an operating base portion 23 as an elongated plate, a center portion 24 extending from one surface of the operating base portion 23, a detecting spring portion (detecting portion) 25 extending from the center portion 24 in the mating direction A, a pair of holding spring portions (holding portions) 27 located on opposite sides of the center portion 24, and a pair of operating spring portions (operating portions) 29 located on opposite sides of the center portion 24.

The operating base portion 23 extends long in a direction C perpendicular to an axis X parallel to the mating and the unmating directions A and B. The center portion 24 extends along the axis X from the one surface of the operating base portion 23 in the mating direction A.

The detecting spring portion 25 extends from the center portion 24 along the axis X. The detecting spring portion 25 is a portion for detecting a mated state and an unmated state of the first connector 11 and the second connector 31. The detecting spring portion 25 is adapted to be engaged with the lock lever 18 of the first connector 11.

The detecting spring portion 25 has a detecting locking portion 25*a* as a protrusion formed near its end in the mating direction A to be engaged with the lever locking portion 18*a* of the lock lever 18.

The holding spring portions 27 are connected to one end of the center portion 24 in the mating direction A and extend in the unmating direction B to be opened outward. The holding spring portions 27 are located on opposite sides of the axis X. The holding spring portions 27 lock the detecting member 21 to the first connector 11 in the unmated state. Specifically, the holding spring portions 27 are displaced in the direction C different from sliding movement of the mating detecting member 21 in the mating and the unmating directions A and B to be engaged with the first connector 11.

The operating spring portions 29 are connected to the one surface of the operating base portion 23 in the mating direction A and extend along the axis X on opposite sides of the axis X. The operating spring portions 29 serve to lock the mating detecting member 21 to the first connector 11. The operating spring portions 29 have hook-like protrusions 29*a* formed at their ends and protruding inward. Each of the protrusions 29*a* has an outer inclined edge 29*b* formed on its outer surface and gently curved so as to be easily inserted in the mating direction A. Each of the protrusions 29*a* has an inner inclined edge 29*c* formed on its inner surface and acutely curved so as to prevent the mating detecting member 21 from being released from the first connector 11 in the unmating direction B.

As shown in FIGS. 3 and 6, the first connector 11 has a pair of inner wall portions 19. The inner wall portions 19 are inserted between the operating spring portions 29 and the holding spring portions 27 of the mating detecting member 21 when the mating detecting member 21 is inserted into the detecting locking portion 17 of the first connector 11.

The inner wall portions 19 have holding protrusions 19*a* formed at their ends in the unmating direction B and protruding inward, and operating protrusions 19*b* formed at their intermediate positions and protruding outward from outer surfaces of the inner wall portions 19. The operating protrusions 19*b* have inclined edges 19*c* formed on one surface facing the unmating the other surface facing the mating direction A.

As shown in FIGS. 1 and 2, the second connector 31 has a second mating portion 33 as a large groove and a mating detecting portion 35 as a groove.

The second mating portion 33 receives the first mating portion 13 of the first connector 11 inserted in the mating direction A to be mated thereto. The mating detecting portion 35 receives the detecting locking portion 17 inserted in the mating direction A to be mated thereto.

The mating detecting portion 35 has an upper outer wall 31*a* provided with a window 37 opened between an outside and an inside of the mating detecting portion 35. The second connector 31 has a wall 31*e* facing the mating direction A and provided with a plurality of holes 31*f* adapted to receive a plurality of mating contacts (not shown) inserted therethrough.

Now, each of functions of preventing the mating detecting member 21 from being easily released from the first connector 11, detecting the mated state, and preventing the first connector 11 at an assurance position from easily moving therefrom will be described with reference to the drawing.

Herein, the assurance position represents a state where the first connector 11 and the second connector 31 are completely mated with each other. A standby position represents a state where the first connector 11 and the second connector 31 are not mated.

Figure 9:
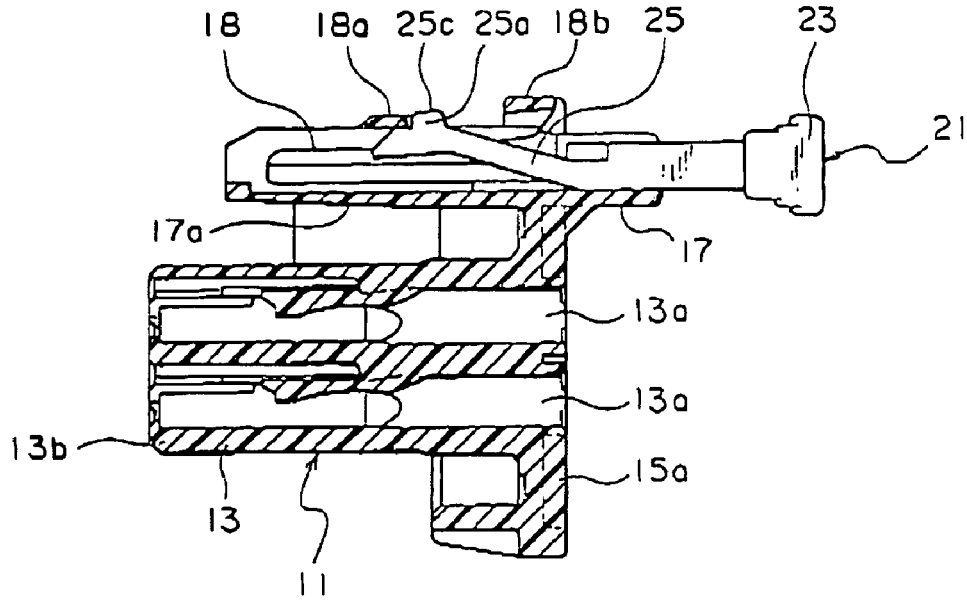
FIG. 9 is a vertical sectional view of the connector and the mating detecting member illustrated in FIG. 1 with the mating detecting member located at a standby position.
Figure 10:
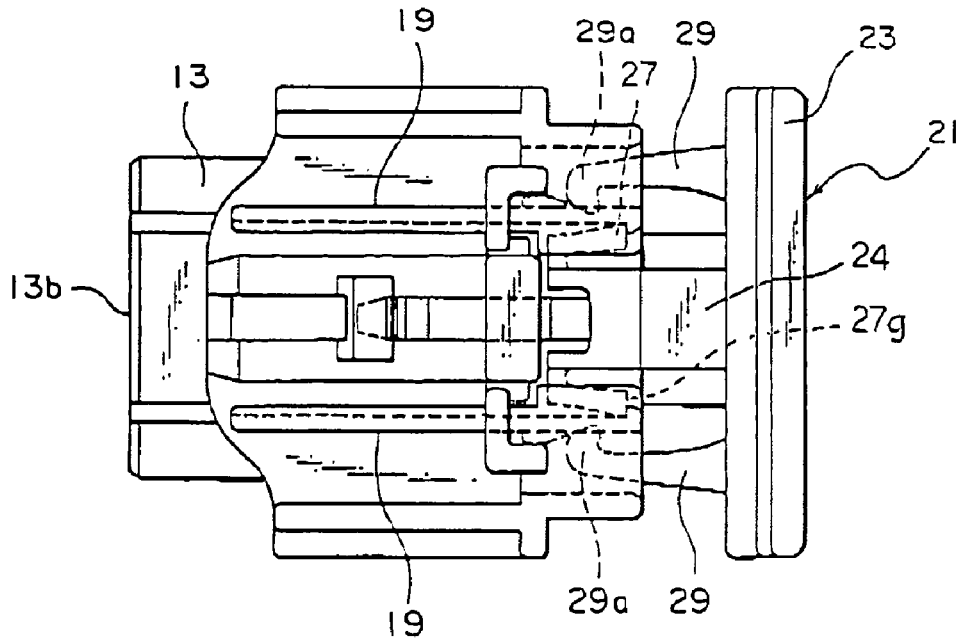
FIG. 10 is a plan view corresponding to FIG. 9.
Figure 11:
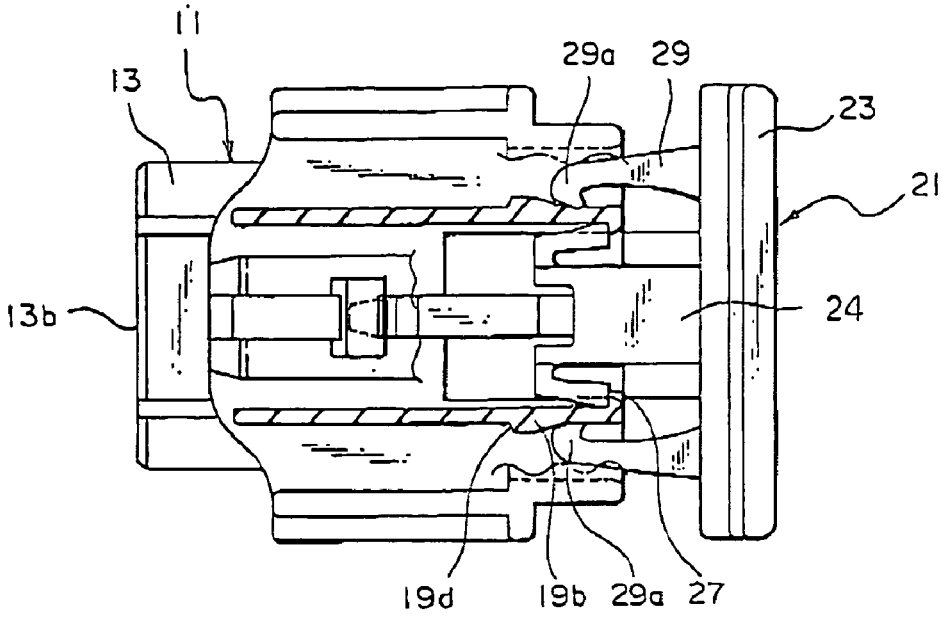
FIG. 11 is a plan view, partially in section, corresponding to FIG. 10.

Referring to FIGS. 9 through 11, the first connector 11 is located at the standby position together with the mating detecting member 21. When the first connector 11 is at the standby position, the detecting locking portion 25*a* of the detecting spring portion 25 is engaged with the lever locking portion 18*a* on a side facing the unmating direction B. At this time, the mating detecting member 21 is inhibited from being moved from the standby position to the assurance position.

As shown in FIGS. 10 and 11, the holding spring portions 27 of the mating detecting member 21 are deformed towards each other so that the mating detecting member 21 is coupled with the first connector 11. The holding spring portions 27 have ends 27*g* which are engaged with the holding protrusions 19*a* formed on inner surfaces of the inner wall portions 19 of the first connector 11 when the mating detecting member 21 is coupled. Therefore, the mating detecting member 21 is prevented from being easily released in the unmating direction B. At this time, the protrusions 29*a* of the operating spring portions 29 are engaged with the inclined edges 19*c* of the operating protrusions 19*b*.

As described above, at the standby position, the detecting locking portion 25*a* is engaged with the lever locking portion 18*a* so that the mating detecting member 21 can not be inserted to the assurance position.

Figure 12:
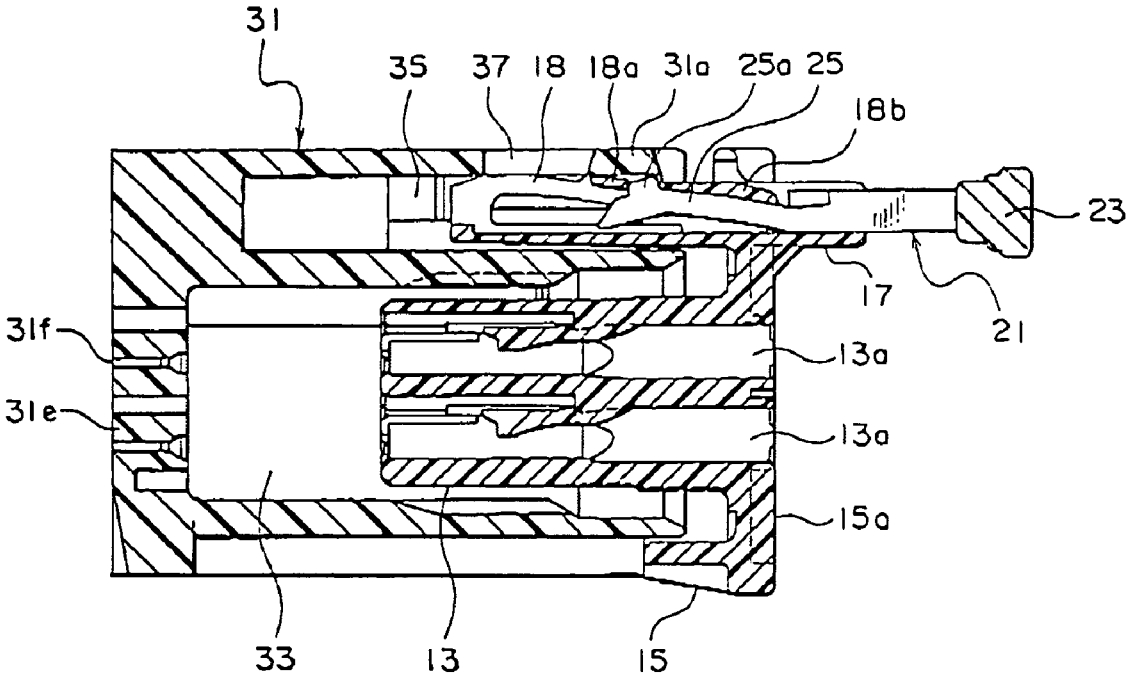
FIG. 12 is a vertical sectional view of the connector and the mating detecting member illustrated in FIG. 1 in the middle of a mating operation with the mating detecting member located at the standby position.
Figure 13:
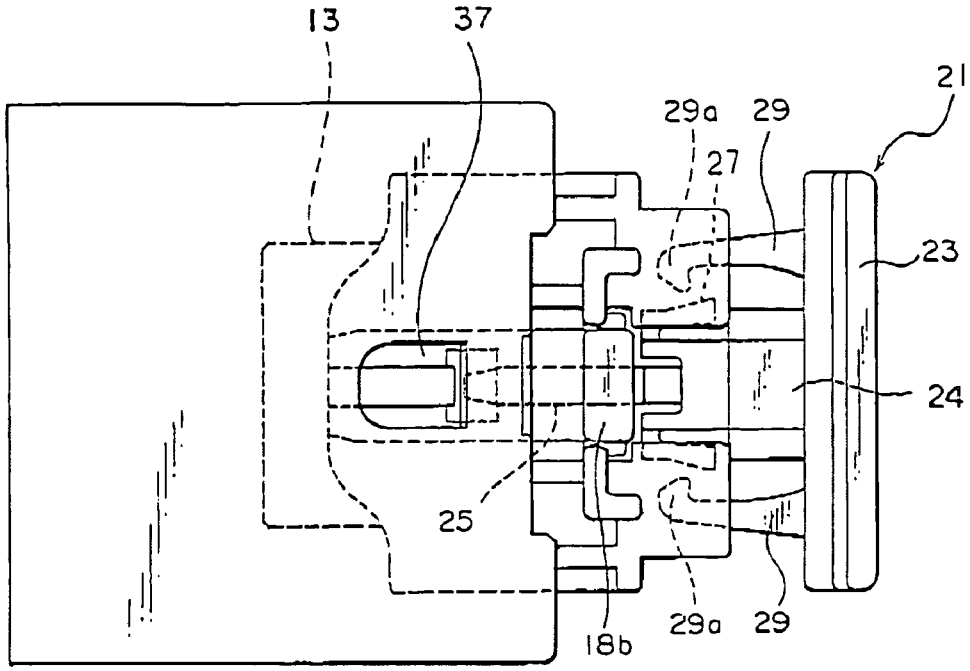
FIG. 13 is a plan view corresponding to FIG. 12.

Referring to FIGS. 12 and 13, the first connector 11 is inserted into the second connector 31 but is not yet mated thereto. The mating detecting member 21 is at the standby position.

Referring to FIGS. 12 and 13, the lever locking portion 18*a* of the lock lever 18 and the detecting locking portion 25*a* of the detecting spring portion 25 are depressed by the upper outer wall 31*a* of the second connector 31 to be deformed.

Figure 14:
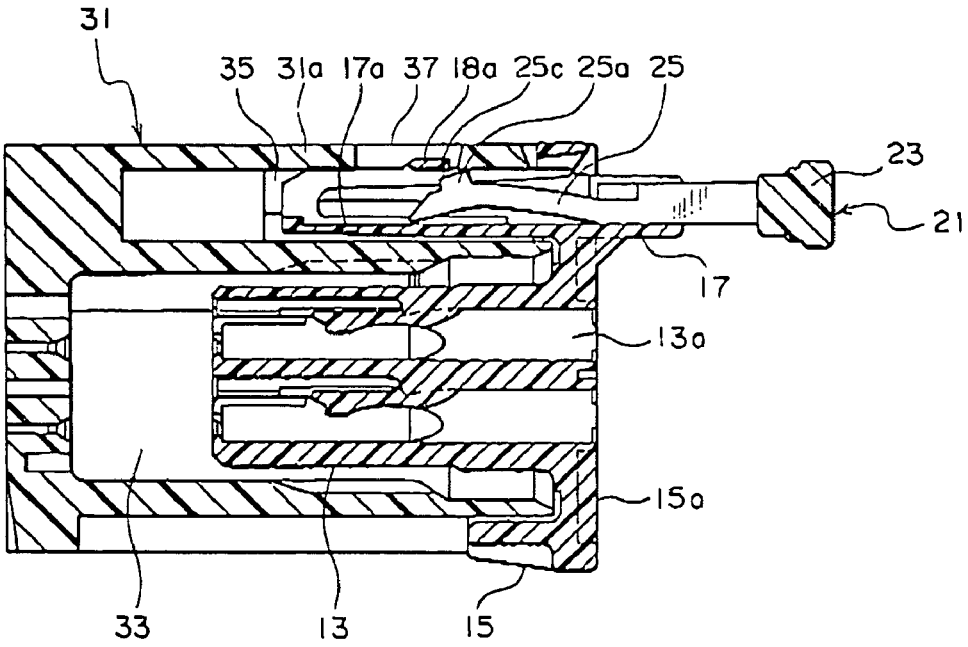
FIG. 14 is a vertical sectional view of the connector and the mating detecting member illustrated in FIG. 1 in the mated state with the mating detecting member located at the standby position.
Figure 15:
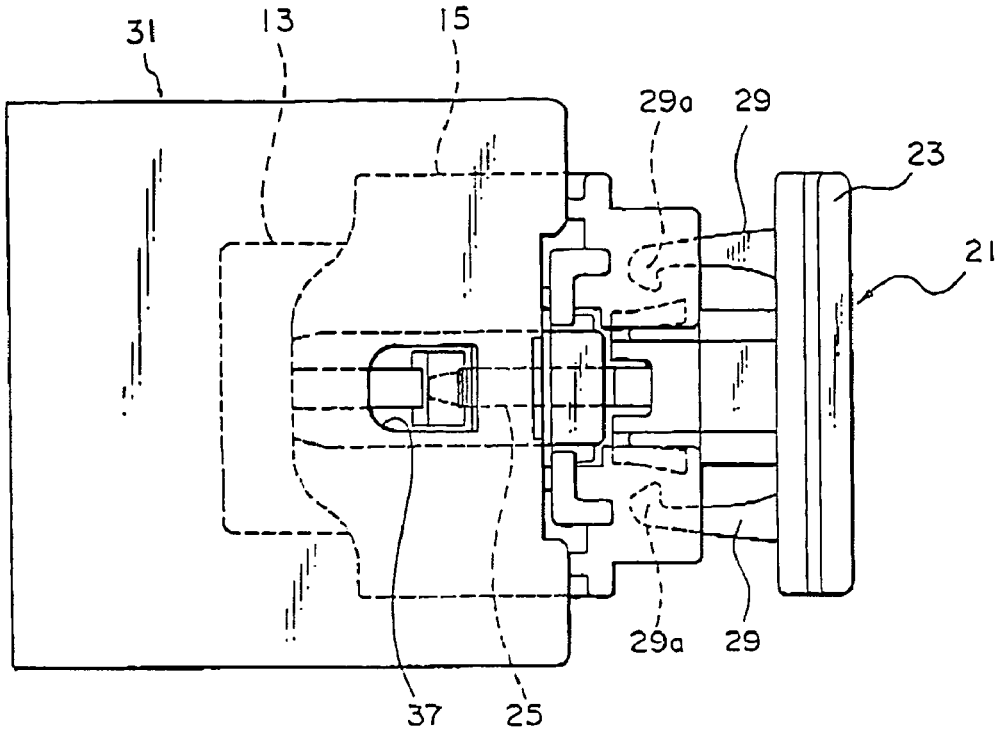
FIG. 15 is a plan view corresponding to FIG. 14.

Referring to FIGS. 14 and 15, the first and the second connectors 11 and 31 are mated to each other. After completion of mating between the first and the second connectors 11 and 31, the lever locking portion 18*a* is located at the window 37 in the outer wall 31*a* so that the lock lever 18 is returned from a deformed state into a natural state. At this time, the detecting locking portion 25*a* of the detecting spring portion 25 is still located under the outer wall 31*a* so that the detecting spring portion 25 is kept deformed. In the state where the detecting spring portion 25 is deformed, the mating detecting member 21 is unlocked and allowed to be inserted to the assurance position. When the mating detecting member 21 is inserted to the assurance position, the operating spring portions 29 are easily deformed along the inclined edge 19*c* of the operating protrusion 19*b* so that an operating force can be reduced.

Upon completion of mating between the first and the second connectors 11 and 31, the lever locking portion 18*a* of the lock lever 18 is engaged with the window 37 of the second connector 31 to be recovered into its original shape. On the other hand, a top edge 25*c* of the detecting locking portion 25*a* is kept pressed against the outer wall portion 31*a* of the second connector 31. At this time, the detecting spring portion 25 is disengaged from the lock lever 18.

Therefore, only when the first connector 11 is mated to the second connector 31, the detecting spring portion 25 is disengaged so that the mating detecting member 21 is movable. It is therefore possible to reliably execute the function of detecting the mated state. Thus, by the operating spring portions 29 and the operating protrusions 19*b*, the mating detecting member 21 can easily be inserted from the standby position and can not easily be removed from the assurance position.

Further, as illustrated in FIG. 1, when the mating detecting member 21 is inserted to the assurance position, the detecting spring portion 25 is recovered from the deformed state into the natural state. At this time, since the detecting locking portion 25*a* of the detecting spring portion 25 can be seen through the window 37, it is possible to visually confirm the mated state of the first connector 11.

If it is tried to move the mating detecting member 21 from the assurance position to the standby position, removal is difficult because of presence of the acute inclined edges 29*c* formed on the protrusions 29*a* of the operating spring portions 29.

When the mating detecting member 21 is located at the standby position, the operating spring portions 29 are engaged with the inclined edges 19*c* gently curved so that the mating detecting member 21 is slidable. When the mating detecting member 21 is located at the assurance position, the operating spring portions 29 are engaged with the acute inclined edges 19*d* so that the mating detecting member 21 is prevented from being returned to the standby position.

Figure 16:
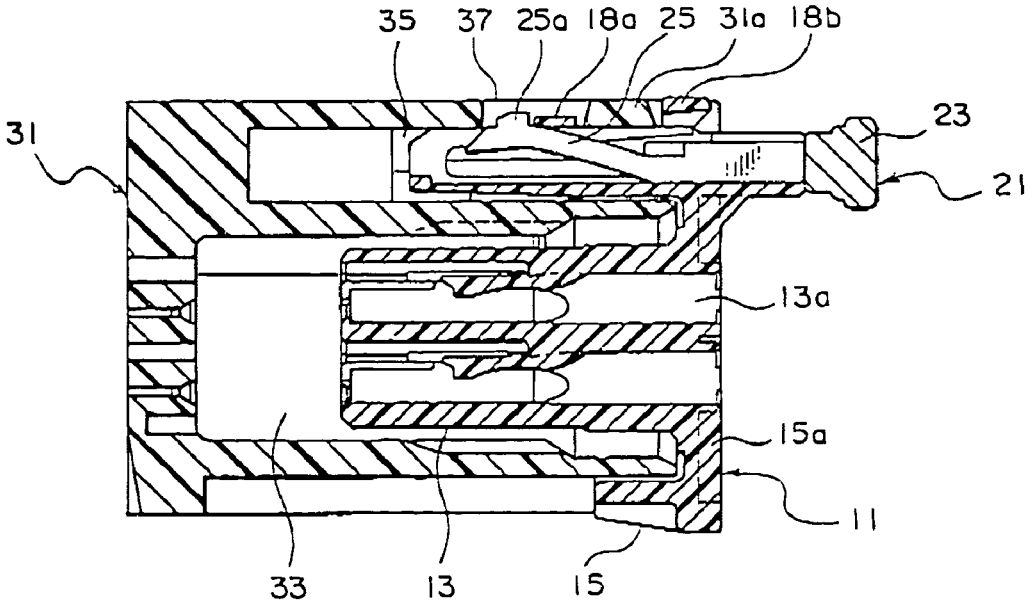
FIG. 16 is a vertical sectional view of a connector apparatus according to a second embodiment of this invention.
Figure 17:
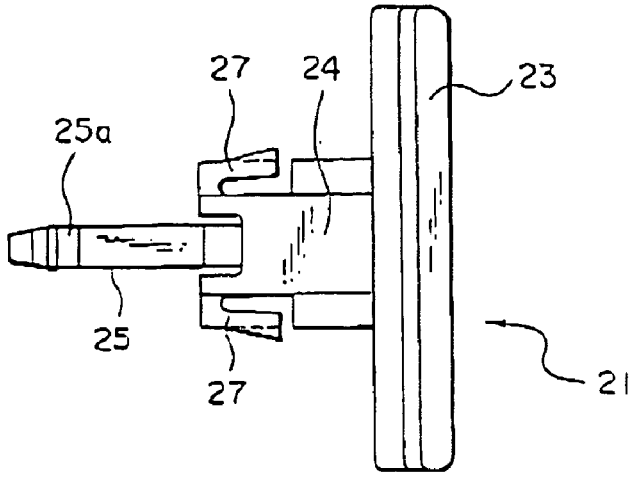
FIG. 17 is a plan view of a mating detecting member illustrated in FIG. 16.
Figure 18:
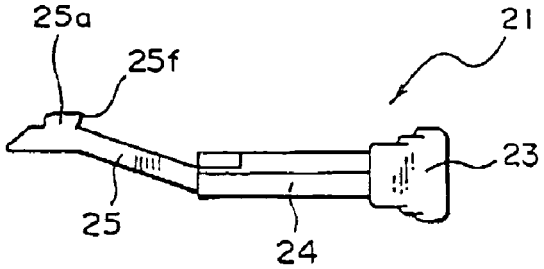
FIG. 18 is a side view of the mating detecting member illustrated in FIG. 16.

Referring to FIGS. 16 through 18, a connector apparatus according to a second embodiment is similar to the first embodiment except that the mating detecting member 21 does not have the operating spring portions 29. Similar parts are designated by like reference numerals and description thereof will be omitted.

In the connector apparatus according to the second embodiment, the detecting locking portion 25*a* of the detecting spring portion 25 has an acute inclined edge 25*f* with respect to the lever locking portion 18*a* of the lock lever 18. The mating detecting member 21 can not easily be removed because of presence of the acute inclined edge 25*f*. Herein, the acute inclined edge 25*f* is inclined from the detecting spring portion 25 in the unmating direction B.

Figure 19:
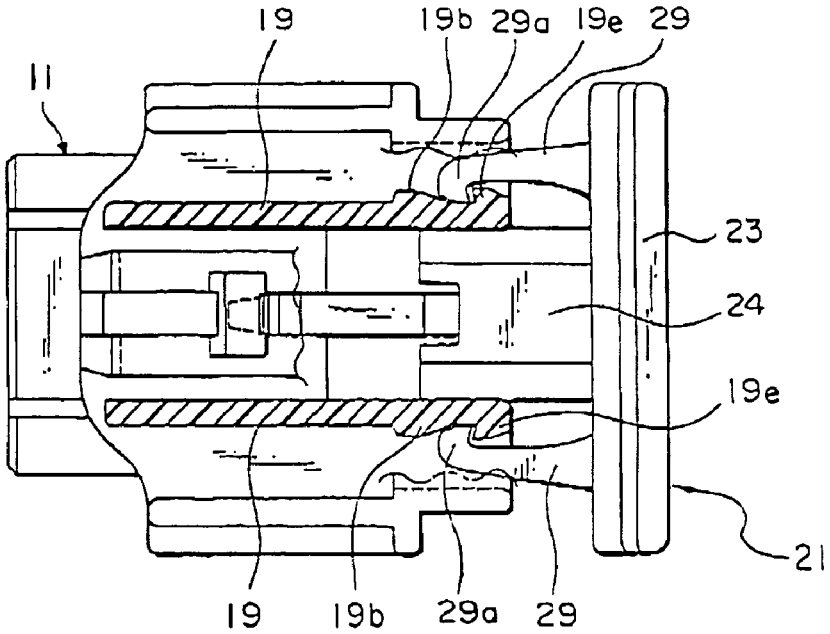
FIG. 19 is a plan view, partially in section, of a connector apparatus according to a third embodiment of this invention.
Figure 20:
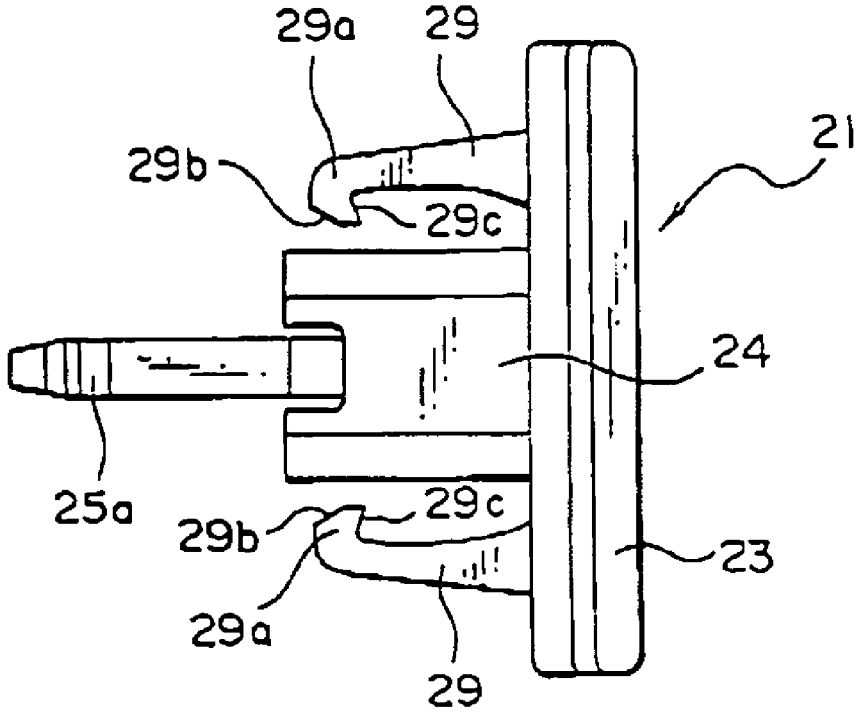
FIG. 20 is a plan view of a mating detecting member illustrated in FIG. 19.
Figure 21:
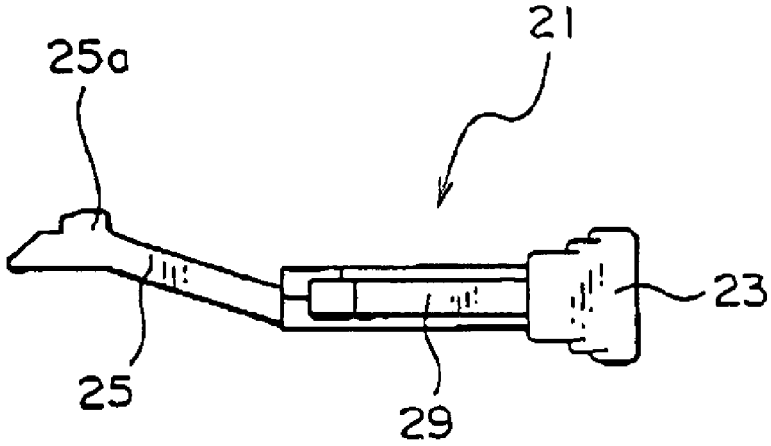
FIG. 21 is a side view of the mating detecting member illustrated in FIG. 20.

Referring to FIGS. 19 through 21, a connector apparatus according to a third embodiment is similar to the first embodiment except that the mating detecting member 21 does not have the holding spring portions 27. Similar parts are designated by like reference numerals and description thereof will be omitted.

In the third embodiment, the inner wall portions 19 are inserted between the center portion 24 and the operating spring portions 29 of the mating detecting member 21 when the mating detecting member 21 is inserted into the detecting locking portion 17 of the first connector 11. The inner wall portions 19 have holding protrusions 19*e* formed at their ends in the unmating direction B and protruding outward. The protrusions 29*a* of the operating spring portions 29 are engaged with the holding protrusions 19*e* at the standby position so that the mating detecting member 21 is not easily released.

As described above, the connector apparatus according to this invention achieves the functions of detecting the mated state, preventing the first connector 11 at the assurance position from being easily moved, and preventing the mating detecting member 21 itself from being easily released from the first connector 11.

This invention is applicable to the connector apparatus capable of preventing the first and the second connectors in the mated state from being undesirably released by the vibration, the mechanical shock, or the like. In particular, the connector apparatus is suitable as a component mounted to a support panel of an automobile to connect electronic apparatuses to each other.

While this invention has thus far been described in conjunction with the preferred embodiments thereof, it will be readily possible for those skilled in the art to put this invention into practice in various other manners.

What is claimed is:

1. A connector apparatus comprising:

a first connector;

a second connector to be mated with and unmated from the first connector in a mating direction and an unmating direction opposite to the mating direction; and a mating detecting member coupled to the first connector and slidable along the first connector in the mating and the unmating directions, wherein:

the first connector has a lock lever to be engaged with the second connector, and the mating detecting member includes:

an elastically deformable detecting locking portion for detecting the mated state and the unmated state of the first and the second connectors;

a holding portion for locking the first connector at a standby position where the first and the second connectors are in the unmated state; and an operating portion for locking the first connector at an assurance position where the first and the second connectors are in the mated state, the detecting portion having a locking portion to be engaged with the lock lever at the assurance position so that the mating detecting member is engaged with the first connector and prevented from being returned to the standby position, the holding portion being displaced in a direction different from the mating and the unmating directions to be engaged with the first connector, the operating portion making the mating detecting member be slidable from the standby position when the first connector is mated to the second connector, the operating portion having a protrusion to be engaged with the first connector, and the first connector having an operating protrusion to be engaged with the protrusion at the assurance position to inhibit the movement from the assurance position in the unmating direction.

2. The connector apparatus according to claim 1, wherein the lock lever has a lever locking portion to be engaged with the detecting locking portion.

3. The connector apparatus according to claim 1, wherein the mating detecting member includes a center portion adapted for coupling the first connector, the detecting portion extending from the center portion in the mating direction, the holding portion extending from the center portion to locate beside the center portion, the operating portion extending from the center portion to locate beside the holding portion.

4. The connector apparatus according to claim 3, wherein the lock lever has a lever locking portion, the detecting locking portion having an acute inclined edge for being engaged with the lever locking portion.

5. A connector apparatus comprising:

a first connector:

a second connector to be mated with and unmated from the first connector in a mating direction and an unmating direction opposite to the mating direction; and a mating detecting member coupled to the first connector and slidable along the first connector in the mating and the unmating directions, wherein:

the first connector has a lock lever to be engaged with the second connector, and the mating detecting member includes:

an elastically deformable detecting portion for detecting the mated state and the unmated state of the first and the second connectors;

a holding portion for locking the first connector at a standby position where the first and the second connectors are in the unmated state; and an operating portion for locking the first connector at an assurance position where the first and the second connectors are in the mated state, the detecting portion having a detecting locking portion to be engaged with the lock lever at the assurance position so that the mating detecting member is engaged with the first connector and prevented from being returned to the standby position, the holding portion being displaced in a direction different from the mating and the unmating directions to be engaged with the first connector, the operating portion making the mating detecting member be slidable from the standby position when the first connector is mated to the second connector, @wherein each of the lock lever, the detecting portion, the holding portion, and the operating portion is elastically deformable.

6. A connector apparatus comprising:

a first connector;

a second connector to be mated with and unmated from the first connector in a mating direction and an unmating direction opposite to the mating direction; and a mating detecting member coupled to the first connector and slidable along the first connector in the mating and the unmating directions, wherein:

the first connector has a lock lever to be engaged with the second connector, and the mating detecting member includes:

an elastically deformable detecting portion for detecting the mated state and the unmated state of the first and the second connectors;

a holding portion for locking the first connector at a standby position where the first and the second connectors are in the unmated state; and an operating portion for locking the first connector at an assurance position where the first and the second connectors are in the mated state, the detecting portion having a detecting locking portion to be engaged with the lock lever at the assurance position so that the mating detecting member is engaged with the first connector and prevented from being returned to the standby position, the holding portion being displaced in a direction different from the mating and the unmating directions to be engaged with the first connector, the operating portion making the mating detecting member be slidable from the standby position when the first connector is mated to the second connector, wherein the first connector has an inner wall portion which has a holding protrusion protruding inward and an operating protrusion protruding outward, the holding portion being adapted for engaging with the holding protrusion when the mating detecting member is coupled to the first connector.

7. The connector apparatus according to claim 6, wherein the mating detecting member includes a center portion adapted for coupling the first connector, the inner wall portion being inserted between the center portion and the operating portion when the mating detecting member is coupled to the first connector.

8. The connector apparatus according to claim 7, wherein the inner wall portion has a holding protrusion protruding outward for locking the operating portion.

9. The connector apparatus according to claim 7, wherein the first connector has a detecting locking portion at a peripheral portion thereof, the mating detecting member being inserted into the detecting locking portion.

* * * * *